United States Patent [19]

Nakamura

[11] 4,015,913

[45] Apr. 5, 1977

[54] DIAPHRAGM AIR PUMP

[75] Inventor: Hirokazu Nakamura, Kyoto, Japan

[73] Assignee: Mitsubishi Jidosha Kogyo Kabushiki Kaisha, Tokyo, Japan

[22] Filed: Feb. 27, 1975

[21] Appl. No.: 553,473

[30] Foreign Application Priority Data

Dec. 20, 1974 Japan ..... 49-145543

[52] U.S. Cl. ..... 417/471; 92/84

[51] Int. Cl.[2] ..... F16J 1/10; F04B 19/22; F04B 45/04

[58] Field of Search ..... 92/84; 417/471

[56] References Cited

UNITED STATES PATENTS

| | | | |
|---|---|---|---|
| 1,905,284 | 4/1933 | Hertzer | 417/471 |
| 2,022,660 | 12/1935 | Flint | 92/84 |
| 2,055,154 | 9/1936 | Mantle | 92/84 |
| 2,811,929 | 11/1957 | Rupp | 92/84 |
| 2,895,424 | 7/1959 | Tramontini et al. | 92/84 |
| 3,186,343 | 6/1965 | Schneider | 92/84 |
| 3,372,624 | 3/1968 | Rietdijk | 92/84 |
| 3,433,263 | 3/1969 | Sebestyen | 92/84 |

FOREIGN PATENTS OR APPLICATIONS

| | | | |
|---|---|---|---|
| 350,817 | 6/1931 | United Kingdom | 92/84 |

*Primary Examiner*—William L. Freeh
*Attorney, Agent, or Firm*—Oldham & Oldham Co.

[57] ABSTRACT

A diaphragm air pump comprising a diaphragm assembly in a housing to define therewithin a compression chamber and connecting means for transmitting an actuating force from a shaft of an engine to said assembly. The air pump includes resilient means between a diaphragm and said connecting means, thereby increasing the output of the pump at low or middle speed revolutions of the engine.

3 Claims, 3 Drawing Figures

DIAPHRAGM AIR PUMP

BACKGROUND OF INVENTION

This invention relates to an air pump, especially a diaphragm air pump, for use in a purifying system of exhaust gas for a motor vehicle.

Conventional rotary air pumps for use in purifying systems of exhaust gas are actuated by crankshafts or other shafts of the engines. Thus, the output of this type of air pump increases proportionally to the increase of revolutions of the crankshaft of the engine. However, secondary air from the air pump should be supplied to the purifying system for example to a thermal reactor at low or middle revolutions of the engine of the vehicle, but not so necessarily to be supplied at high revolutions thereof. In the conventional air pump, there is a main problem that the output of the pump is specially low at the low revolutions of the engine, so that it is necessary to use an air pump of large volume to operate perfectly the purifying system at the low revolutions. Also, in a diaphragm air pump in which a diaphragm is actuated through without use of resilient means, there is a problem in durability of the diaphragm, in addition to the above drawback, since frequency of oscillations and inertia force of the diaphragm increase proportionally to the increase of revolutions of the crankshaft.

SUMMARY OF INVENTION

An important object of this invention is to provide a diaphragm air pump of which the output is high at the low or middle revolutions of the engine but is low at high revolutions thereof.

According to the invention, there is provided a diaphragm air pump comprising a housing, a diaphragm assembly mounted in said housing to define therewithin a compression chamber, and connecting means connected to said diaphragm assembly and adapted to transmit thereto an actuating force from a shaft driven by an engine of a vehicle, said diaphragm assembly including resilient means located between a flexible diaphragm secured at its outer periphery to said housing and said connecting means.

BRIEF DESCRIPTION OF THE DRAWINGS

This invention will be explained by way of example with reference to the accompanying drawings in which.

DESCRIPTION OF THE PREFERRED EMBODIMENTS

Figure 1:
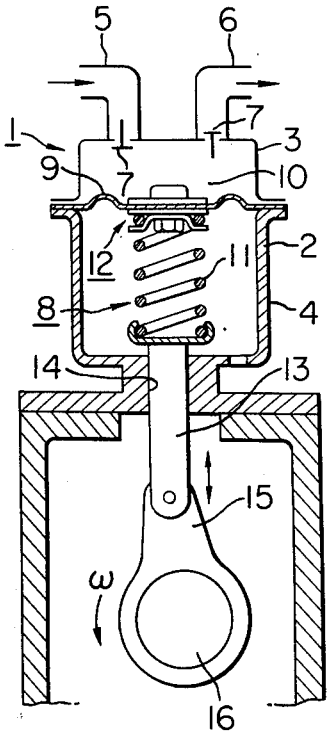
FIG. 1 shows a diagrammatic cross section of a diaphragm air pump according to the invention.

Referring to FIG. 1, a diaphragm air pump 1 includes a housing 2 which consists of a cover 3 and a body 4. The cover 3 has an inlet port 5 and an outlet port 6 in which one way check valves 7, such as lead valves, are mounted respectively. The cover 3 and the body 4 are securely connected to each other in fluid-tight manner by suitable means such as bolts.

A diaphragm assembly 8 is mounted within the housing 2. The diaphragm assembly 8 includes a flexible diaphragm 9 which is tightened at its outer periphery between the cover 3 and the body 4 to define a compression chamber 10 within the housing 2. Also, the diaphragm assembly 8 includes resilient means such as a coil spring 11, one end of which is connected to the diaphragm 9 through a retainer 12 while the other end of the spring is supported by a retainer fixed to a rod 13 extending through a central bore 14 in the bottom of the body 4.

Connecting means comprises a connecting rod 15, one end of which is pivotally connected to the rod 13 by a pin. The other end of the connecting rod 15 is rotatably mounted on a cam 16 which is connected to and actuated by a crankshaft or balancer shaft of the engine, not shown.

Figure 2:
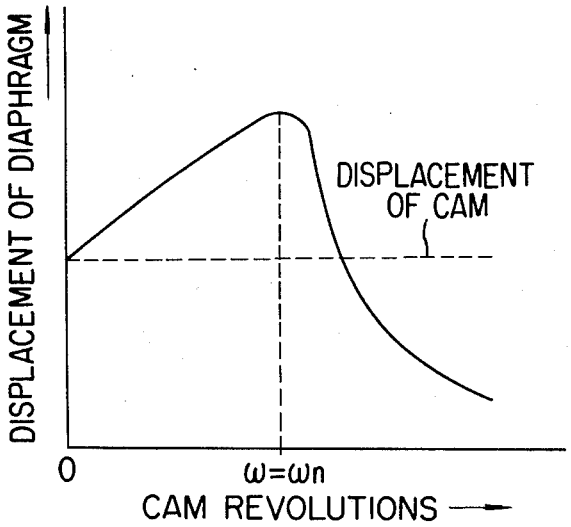
FIG. 2 is a diagram indicating displacement of a diaphragm with respect to revolutions of a cam of the air pump in FIG. 1.
Figure 3:
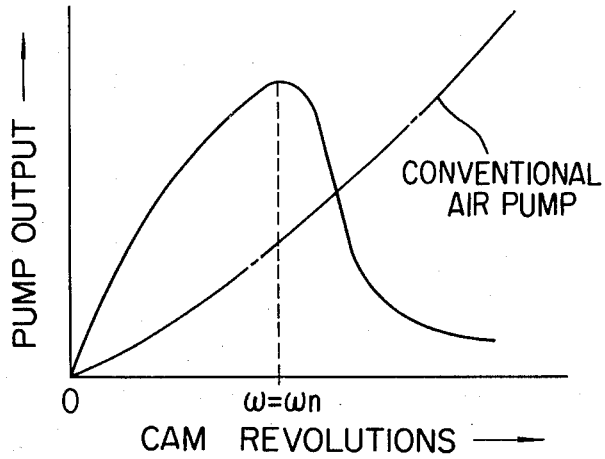
FIG. 3 is a diagram indicating output of the air pump with respect to the revolutions of the cam.

The diaphragm air pump 1 is designed to utilize the resonance phenomenon of the diaphragm assembly 8 so that the output thereof is high at low or middle revolutions of the engine, but is extremely low at high revolutions. Assuming that mass $m$ is the weight of the diaphragm with a half weight of the spring and $k$ is spring constant of the spring 11, frequency $\omega_n$ of natural oscillation of the diaphragm assembly is represented by $\omega_n = \sqrt{k/m}$. Also, assuming that $\omega$ is revolutions of the cam 16, the frequency of forced vibration effected on the rod 13 of the diaphragm assembly through the connecting rod 15 is represented by $\omega$. As shown in FIG. 2, displacement of the diaphragm 9 increases gradually above the displacement of the cam 16 upon increase of the revolutions $\omega$ thereof. When the revolutions $\omega$ of the cam 16 is equal to the frequency $\omega_n$ of natural oscillation of the diaphragm assembly 8, that is when attaining a resonance point, the displacement of the diaphragm 9 reaches to the maximum so that the output of the air pump is also maximum, as shown in FIG. 3. Further increase of the revolutions of cam 16 causes to decrease rapidly the displacement of the diaphragm 13, therefore the output of the pump is also decreased.

In the conventional air pump, the output thereof increases proportionally to the increase of the revolutions of the cam, as shown in a chain line in FIG. 3. According to this invention, the diaphragm 9 is operated to be displaced above the displacement of the cam 16 at the resonance point of the diaphragm assembly, so that the output of the pump above the theoretical volume effeciency of 100% can be obtained. It will be understood that the spring constant $k$ of the spring 11 is adequately selected to establish maximum output of the pump 1 when the rotation of the cam, therefore the engine, reaches to a desired speed, since the secondary air from the outlet port 6 of the air pump is desired to be supplied to the exhaust gas purifying system at the low or middle revolutions of the engine.

The diaphragm air pump according to the invention is so constructed that the displacement of the diaphragm is extremely low at high revolutions of the cam. Therefore, the inertia force of diaphragm will not be increased and durability of components of the pump, specially of the diaphragm having the disadvantage in use of reciprocating movements at its high speed, is improved, thereby improving reliability of the pump.

Also, the air pump according to the invention has an output characteristics that the output is high at low or middle revolutions of the engine to suit for supplying the secondary air to the exhaust gas purifying system, so that it may be more compacted than the conventional air pump for the purifying system and is simple in construction than rotary air pump, thereby manufactured less constly. In the exhaust gas purifying system comprising the conventional air pump, it is necessary to provide control means such as a relief valve for discharging the secondary air from the pump at high speed of the engine. However, in the exhaust gas purifying system using the air pump according to the invention, it is not necessary to provide such control means, therby reducing the cost of the system.

What is claimed is:

1. A diaphragm air pump comprising a housing, a flexible diaphragm mounted in the housing to define a compression chamber therewithin, one way check valves located in the inlet and outlet ports of the housing, and a coil spring fixed at its one end to said diaphragm and operatively connected at its other end to one end of a first rod positioned for only axial movement, and a connecting rod, being the drive member for the air pump, and having one end pivotally connected to the other end of said first rod, the other end of the connecting rod being rotatably mounted on a cam mounted on a shaft driven by an engine of a motor vehicle and adapted to transmit actuating and retracting forces from the shaft to the diaphragm through said coil spring, whereby output of the pump is high at low or middle revolutions of the engine but is low at high revolutions thereof when the engine shaft revolutions are greater than the natural frequency of an assembly formed of said coil spring and flexible diaphragm, said coil spring being on the axis of said first rod.

2. A diaphragm air pump for use in a system for purifying exhaust gas from an engine of a vehicle to supply air to the purifying system for assisting the purification of the exhaust gas, said diaphragm air pump comprising a housing, a flexible diaphragm mounted in said housing to define a compression chamber therewithin, one way check valves located in inlet and outlet ports of the housing, respectively, said outlet port being adapted to communicate said compression chamber to said purifying system, a resilient means fixed at its one end to said diaphragm to form therewith a diaphragm assembly and at its other end to a rod positioned for only axial movement, and a connecting rod pivotally connected at its one end to said rod, the other end of said connecting rod being rotatably mounted on a cam mounted on a shaft driven by the engine and adapted to transmit an actuating force to the diaphragm through the resilient means, whereby the frequency of oscillation of said diaphragm assembly becomes equal to the frequency of forced reciprocation of said rod through the cam at low or middle revolutions of engine, so that the output of the pump can be set up to be high at low or middle revolutions of the engine but be low at high revolutions thereof.

3. A diaphragm air pump according to claim 1 wherein said resilient means is a coil spring which is on the axis of said rod, said coil spring being the only device connecting said rod to said flexible diaphragm.

* * * * *